US010986909B2

(12) United States Patent
Iwegbu

(10) Patent No.: US 10,986,909 B2
(45) Date of Patent: Apr. 27, 2021

(54) APPARATUS FOR HAIR CURLING

(71) Applicant: Natasha Iwegbu, Washington, DC (US)

(72) Inventor: Natasha Iwegbu, Washington, DC (US)

( * ) Notice: Subject to any disclaimer, the term of this patent is extended or adjusted under 35 U.S.C. 154(b) by 751 days.

(21) Appl. No.: 15/455,052

(22) Filed: Mar. 9, 2017

(65) Prior Publication Data

US 2017/0258192 A1 Sep. 14, 2017

Related U.S. Application Data

(60) Provisional application No. 62/305,752, filed on Mar. 9, 2016.

(51) Int. Cl.
*A45D 2/00* (2006.01)
*A45D 6/04* (2006.01)

(52) U.S. Cl.
CPC ..... *A45D 6/045* (2013.01)

(58) Field of Classification Search
CPC . A45D 6/00; A45D 6/04; A45D 6/045; A45D 6/16; A45D 8/00; A45D 8/14; A45D 8/16; A45D 8/34; A45D 8/36; A45D 2008/006; A45D 2008/345; A44C 5/00; A44C 5/0007; A44C 5/0038; A44C 5/0053; A44C 5/18; A44C 5/185; A44C 5/20; A44C 5/2019; A44C 15/006; A44C 25/007

See application file for complete search history.

(56) References Cited

U.S. PATENT DOCUMENTS 6,289,903 B1 * 9/2001 Haufler ..... A01K 27/006 119/857
2001/0029963 A1 * 10/2001 Neary ..... A45D 8/34 132/210

* cited by examiner

*Primary Examiner* — Rachel R Steitz

(57) ABSTRACT

Disclosed is an apparatus for hair curling. The apparatus includes a base band comprising an inner surface and an outer surface. Further, the apparatus includes curl-forming elements disposed on the outer surface of the base band. Moreover, the apparatus includes connecting elements configured to connect the curl-forming elements to the base band, thereby creating closed loops between the base band and the curl-forming elements, wherein the curl-forming elements follow a contour of the outer surface of the base band. The curl-forming elements are configured to form an outer layer with respect to the outer surface of the base band, wherein the base band forms an inner layer with respect to the curl-forming elements, wherein a closed loop is provided between the outer and inner layers, wherein the closed loop is bounded by the connecting elements.

21 Claims, 20 Drawing Sheets

APPARATUS FOR HAIR CURLING

The current application claims a priority to the U.S. Provisional Patent application Ser. No. 62/305,752 filed on Mar. 9, 2016.

FIELD OF THE INVENTION

The present disclosure generally relates to hair care. More specifically, the present disclosure relates to hair curling and styling devices.

BACKGROUND OF THE INVENTION

People all across the world have been curling and styling their hair since many centuries now. Specially, the grooming and curling of hair has been crucial for the females to meet the standards of beauty laid out by society, in most parts of the world.

Across the world, many methods of hair curling have been practiced. Hair curling devices such as foam rollers, plastic rollers and heated rollers are some of the most widely and frequently used devices for curling hair in females. To use these devices, the user's hair is divided into small sections at the root, the length of hair is then rolled neatly onto the roller, starting at the tip of the hair towards the root. The hair is later dried or set and the rollers removed. Conventional methods that include sectioning and rolling hair can be labor-intensive and inefficient. Typically, the user is unable to see the back or the lower crown of the head to skillfully administer sectioning and curling in these areas and thus requires a certain level of skill by the user in order to complete the job to a satisfactory level. Further, the hair is subject to pulling, tugging and tangling as the sections are divided.

Some users use flexirods and other curling rods to curl their hair. These devices involve wrapping a section of hair around a flexible rod-like device when wet, damp or dry. The hair must be sectioned and each section wrapped around the rod individually. While these devices may be easier to use than the rollers, sectioning the hair is still a requirement. Further, the flexirods can be cumbersome and heavy to carry around in the hair while the style dries and sets.

Further, some users use curling iron and flat irons to curl their hair. These devices involve manually taking a section of hair and seizing it with a clamping plate and wrapping it around the heated barrel for a short period of time until the hair mimics the curvature of the barrel. The hair is then unwound and released. Although these devices require less skill then roller, ironing the hair can be labor-intensive and time intensive, still requiring hair sectioning. Further, this type of direct heat can be extremely damaging to the hair. Further, the high temperatures of curling irons and other heated styling devices have resulted in sustained burns to the skin around the hairline, hands and fingers of the user that may accidentally get in contact with the iron.

Yet further, some users use a headband to curl their hair, which involves wrapping hair around a hairband. These are tricky to use. Typically, the user's hair may get tangled as the hair is wrapped around the band. Further, hair may be snagged and pulled each time the headband is lifted away from the head to wrap and grab the next section of hair causing tugging and potential damage to the hair. Users with longer hair typically run out of hairband space before the length of their hair is wrapped. Further, hair may get displaced and un-wrap, as the user wraps the opposite side of the hair around the band requiring clips and pins to prevent un-wrapping. Further, these devices can only produce one type of style and do not offer the user much flexibility in styling.

Due to the fact that hair curling has been employed since the beginning of modern society, there is a large body of empirical data that suggests that the most successful hair curling devices are the ones that give the user the most control. Further, the users require a device which is instinctive and which does not require the user to have good visibility of the back parts of their hair, thereby promoting user comfort. Hair curling also poses a high risk of hair damage. Sectioning, pulling tugging and yanking the hair are painful and often cause hair breakage. Therefore, an important issue surrounding hair curling is that of ease of use, user comfort and hair health.

Accordingly, there is a need for an apparatus that provides a simple, fast, easy, pain free and effective method of hair curling, such that even unskilled individuals can use the apparatus on themselves. Further, there is a need for an apparatus that is light and easy to use while offering a variety of styles. In addition, there is a need for an apparatus that is simple, and does not require laborious sectioning.

The foregoing objects and advantages of the invention are illustrative of those that can be achieved by the various exemplary embodiments and are not intended to be exhaustive or limiting of the possible advantages which can be realized. Thus, these and other objects and advantages of the various exemplary embodiments will be apparent from the description herein or can be learned from practicing the various exemplary embodiments, both as embodied herein or as modified in view of any variation which may be apparent to those skilled in the art. Accordingly, the present invention resides in the novel methods, arrangements, combinations, and improvements herein shown and described in various exemplary embodiments.

SUMMARY

Disclosed is an apparatus for hair curling. The apparatus includes a base band comprising an inner surface and an outer surface. Further, the apparatus includes one or more curl-forming elements disposed on the outer surface of the base band. Moreover, the apparatus includes one or more connecting elements configured to connect the one or more curl-forming elements to the base band, thereby creating one or more closed loops between the base band and the one or more curl-forming elements, wherein the one or more curl-forming elements follow a contour of the outer surface of the base band. The one or more curl-forming elements are configured to form an outer layer with respect to the outer surface of the base band, wherein the base band forms an inner layer with respect to the one or more curl-forming elements, wherein a closed loop is provided between the outer and inner layers, wherein the closed loop is bounded by the one or more connecting elements.

According to some aspects, a method for hair curling is disclosed. The method includes applying a base band comprising an inner surface and an outer surface and comprising at least one connecting element to the circumference of a user's head. Further, the method includes attaching at least one curl-forming element to the outer surface of the base band using the at least one connecting element. Moreover, the method includes wrapping hair around the at least one curl-forming element by weaving hair thru a closed-loop (created between the outer surface of the base band and the curl forming element). Further, the method includes detaching the curl-forming element from the outer surface of the base band to release the hair.

The disclosed apparatus for hair curling provides a simple, fast, easy, pain free and effective method of hair curling. Further, even unskilled individuals may use the apparatus on themselves. Moreover, the apparatus is light and easy to use. In addition, the apparatus does not require laborious sectioning.

DETAILED DESCRIPTION OF THE INVENTION

Figure 1A:
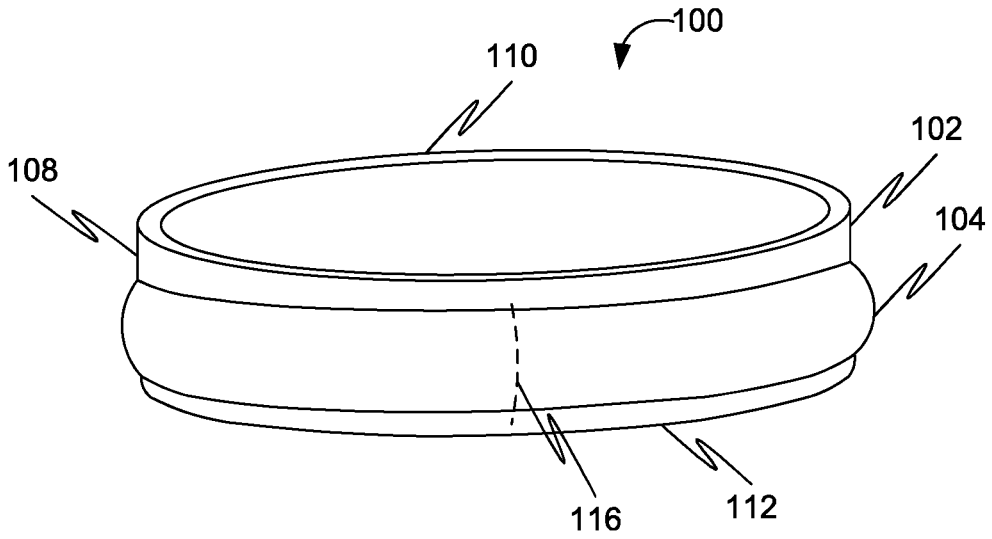
FIG. 1A shows a perspective view of the apparatus, in accordance with various embodiments disclosed herein.

All descriptions are for the purpose of showing selected versions of the present invention and are not intended to limit the scope of the present invention.

Non-limiting and non-exhaustive embodiments of the present invention are described with reference to the preceding figures, wherein like reference numerals refer to like parts throughout the various views unless otherwise precisely specified.

The present disclosure relates to an apparatus for hair curling. The apparatus includes a base band comprising an inner surface and an outer surface. Further, the apparatus includes one or more curl-forming elements disposed on the outer surface of the base band. Moreover, the apparatus includes one or more connecting elements configured to connect the one or more curl-forming elements to the base band, thereby creating one or more closed loops between the base band and the one or more curl-forming elements, wherein the one or more curl-forming elements follow a contour of the outer surface of the base band.

The base band may be an individual loop. The base band may include a first fastener attached to a first end of the base band and one or more second fasteners attached to a second end of the base band, wherein the first fastener is configured to engage with the one or more second fasteners thereby creating an individual loop. Further, at least one of the first fastener and the one or more second fasteners are configured to enable a size of the individual loop to be adjustable.

The bottom edge of the base band may include a cut-out configured to expose a user's forehead when the apparatus is worn by the user. The height of the base band may vary across a length of the base band. For example, the height of the base band may alternate in a periodic fashion. The base band may include an integrated heat protectant layer.

The one or more curl-forming elements may form an individual loop characterized by one of a circular cross-section, a flat cross-section or an amorphous cross-section. The one or more curl-forming elements may include an elongated body having a first end and a second end, wherein a first connecting element and a second connecting element are disposed at the first end and the second end respectively, wherein each of the first connecting element and the second connecting element is configured for mating with corresponding connecting elements disposed on the outer surface of the base band, wherein the mating is one of permanent mating and reversible mating. The one or more curl-forming elements may include multiple curl-forming elements disposed on the outer surface of the base band.

The one or more curl-forming elements may include a first curl-forming element disposed on an upper region of the outer surface of the base band and a second curl-forming element disposed on a lower region of the outer surface of the base band.

The one or more curl-forming elements may be fabricated from one or more of cloth fabric, elastic material, rubber composite, molded plastic, metal sheeting, metal wire, molded foam and foam tubing.

The one or more curl-forming elements may be formed as a hollow tube-like structure, wherein a hollow center of the hollow tube-like structure facilitates air flow through the one or more curl-forming elements. Alternatively, the one or more curl-forming elements may include a rolled up fabric thereby forming a compressible circular cross-section of the one or more curl-forming elements. Moreover, the one or more curl-forming elements may include a twisted length of fabric characterized by an amorphous cross-section.

The one or more curl-forming elements may be characterized by a flat cross-section. Alternatively, the one or more curl-forming elements may be characterized by an alternately varying cross-section. The one or more curl-forming elements may include an element includes a heat-retaining filling.

The one or more connecting elements may be disposed on the outer surface of the base band so as to mate to one or more connecting elements on the one or more curl-forming elements. Further, the one or more connecting elements may include multiple connecting elements disposed on the outer surface of the base band.

The apparatus for hair curling may further include an extension member configured to be an intermediate element between the base band and the one or more curl-forming elements. The extension member may be elongated, wherein the extension member includes a first end and a second end, wherein the extension member may further include multiple connecting elements disposed on the first end and the second end. The extension member may include one or more additional connecting elements arranged in a clustered formation thereby connecting multiple curl forming elements to the base band in a local area. The extension member may be configured to attach to the base band at one of a central point an axis, with multiple connecting elements disposed around one of the central point and the axis. The extension member may include slits thereby creating multiple segmented portions within the extension member, wherein each segmented portion includes one or more connecting elements. The extension member may include a top layer and a bottom layer, wherein the top layer may be attached to the bottom layer, wherein the bottom layer may be configured to be attached to the base band, wherein each of the top layer and the bottom layer may include one or more connecting elements configured to connect the extension member to the one or more curl-forming elements.

Figure 1B:
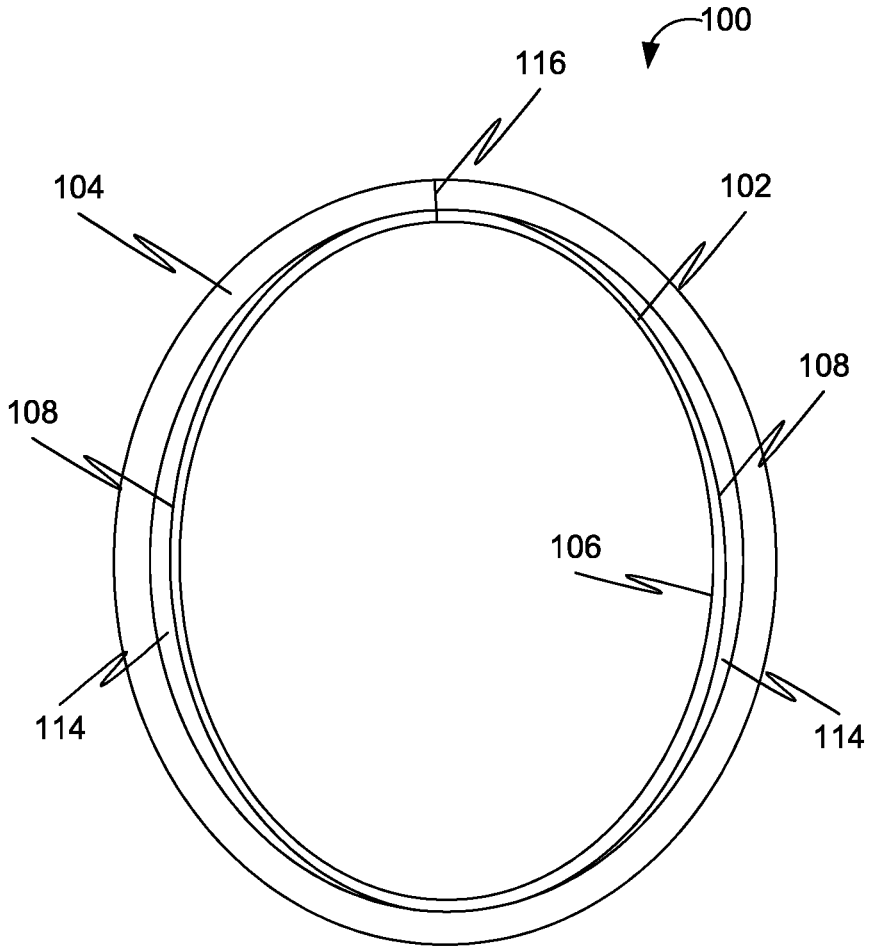
FIG. 1B shows a top view of the apparatus of FIG. 1A.
Figure 1C:
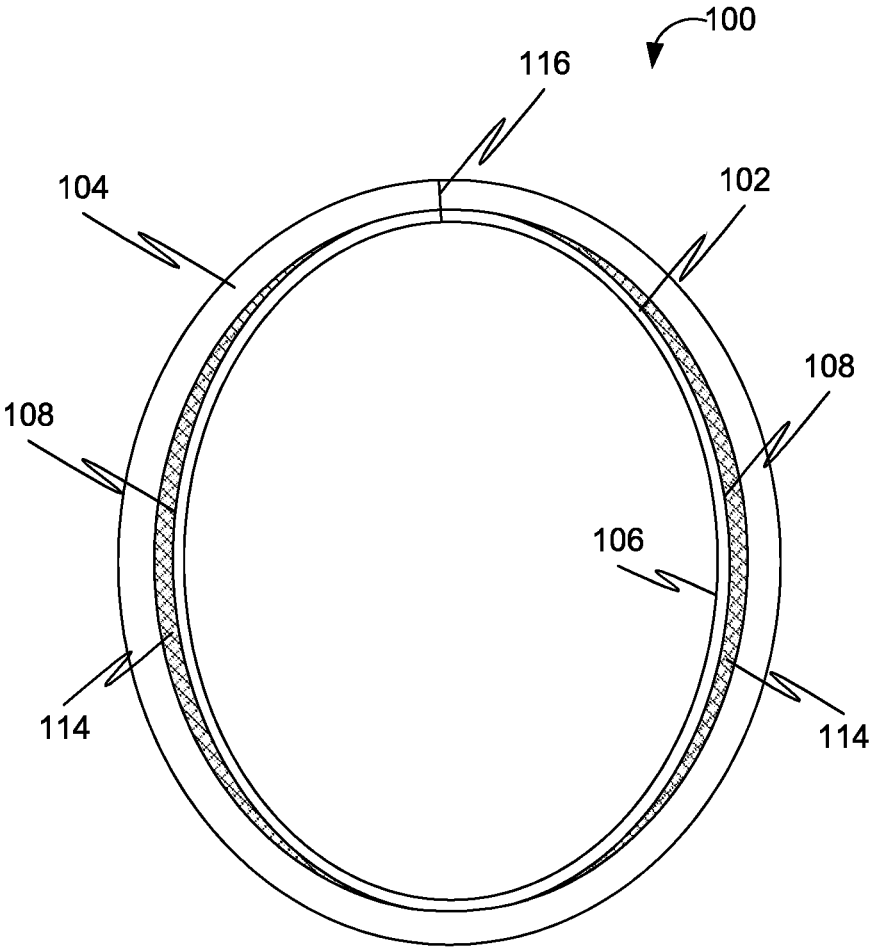
FIG. 1C shows a top view of the apparatus of FIG. 1A.

Referring now to figures, FIGS. 1A-1C show an apparatus 100 for hair curling, in accordance with various embodiments disclosed herein. Specifically, FIG. 1A shows a perspective view of the apparatus 100 and FIGS. 1B-1C show a top view of the apparatus 100. The apparatus 100 may include a base band 102 and a curl-forming element 104. The base band 102 may be an individual loop having an inner surface 106, an outer surface 108, a top edge 110 and a bottom edge 112. The curl-forming element 104 may be an individual loop having a circular cross-section, a flat cross-section or an amorphous cross-section. The two elements (the base band 102 and the curl-forming element 104) may be in contact, where the curl-forming element 104 is on the outer surface 108 of the base band 102, thereby creating a closed loop 114 (highlighted in FIG. 1C) between the outer surface 108 of the base band 102 and the curl-forming element 104. The two elements (the base band 102 and the curl-forming element 104) may be connected by a connecting element 116. The connecting element 116 may connect the base band 102 and the curl-forming element 104 permanently or reversibly. The curl-forming element 104 is configured to form an outer layer with respect to the outer surface 108 of the base band 102, wherein the base band 102 forms an inner layer with respect to the curl-forming element 104, wherein a closed loop 114, is provided between the outer and inner layers, and where the closed loop is bounded by at least one connecting element 116. The connecting element 116 may include one or more of snaps, hooks, loops, holes, VELCRO, stitches, clips or any other attachment means.

Accordingly, an exemplary method for curling hair includes applying the base band 102 to the circumference of the head such that the hair is in contact with the inner surface 106 of the base band 102 and the curl-forming element 104 is on the outer surface 108 of the base band 102. Hair exits the base band 102 from the bottom edge 112. A section of hair is wrapped under and over the outer surface of the curl-forming element 104 pulling the section of hair through the closed-loop 114. The closed-loop 114 includes the outer surface 108 of the base band 102 and the curl-forming element 104. The user's hair is protected by the base band 102, thereby ensuring that there is no snagging or pulling of the user's hair during the wrapping process. The next section of hair encompasses the end portion of the preceding section as well as a new section of hair. The new and preceding sections are bundled together and taken under and over the curl-forming element 104, through the closed-loop 114 in the same manner as described above. This is repeated until all the hair is wrapped around the curl-forming element 104.

Further, an exemplary method for curling hair includes applying the base band 102 to the circumference of the head such that the hair is in contact with the inner surface 106 of the base band 102 and the curl-forming element 104 is on the outer surface 108 of the base band 102. Hair exits the base band 102 from the top edge 110. A section of hair is wrapped over and under the surface of the curl-forming element 104, through the closed-loop 114. The next section of hair encompasses the end portion of the preceding section as well as a new section of hair. The new and preceding sections are bundled together and taken over and through the closed-loop 114 in the same manner as described above. This is repeated until all the hair is wrapped around the curl-forming element 104.

Figure 2A:
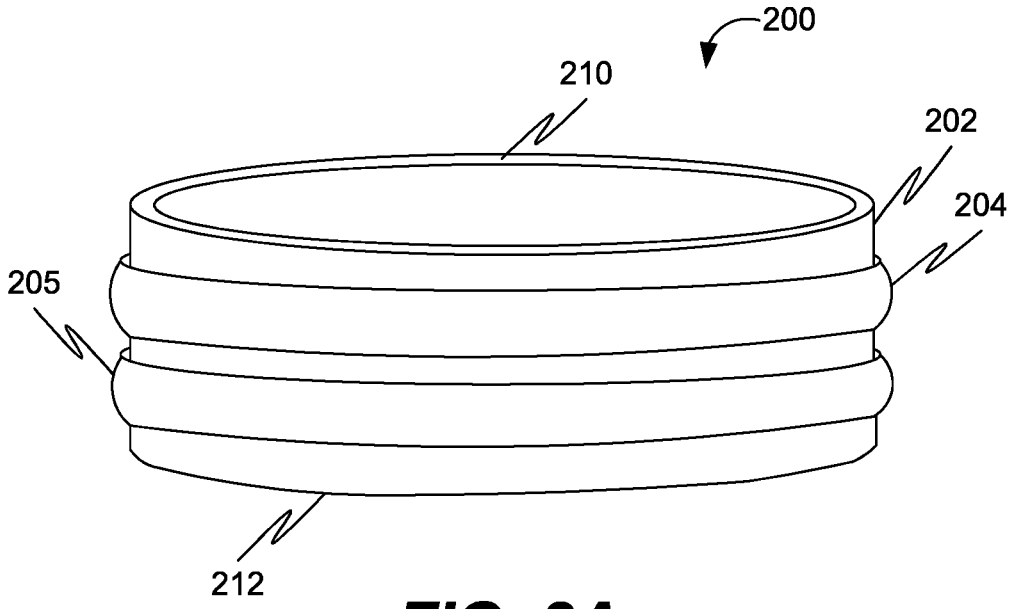
FIG. 2A shows a perspective view of the apparatus for hair curling, in accordance with some embodiments.
Figure 2B:
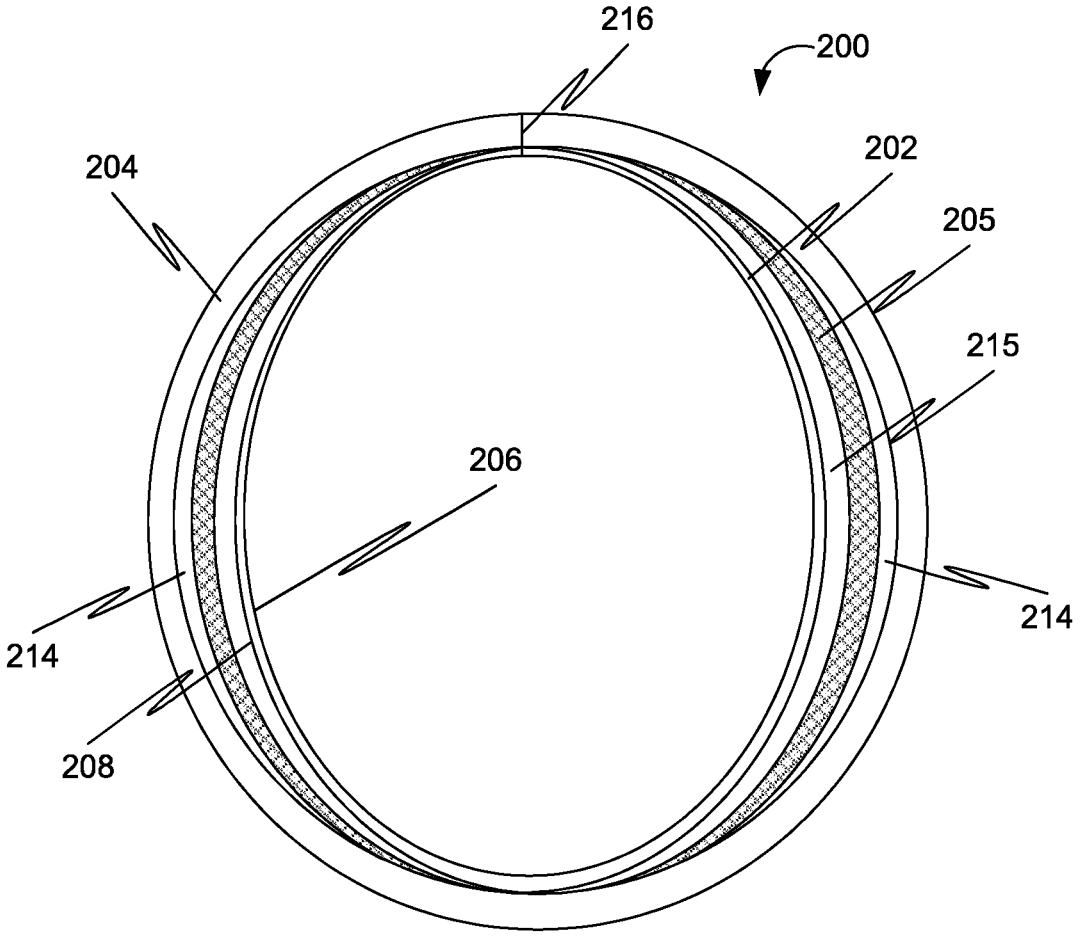
FIG. 2B shows a top view of the apparatus of FIG. 2A.

FIGS. 2A-2B show an apparatus 200 for hair curling, in accordance with some embodiments. Specifically, FIG. 2A shows a perspective view of the apparatus 200 and FIG. 2B shows a top view of the apparatus 200. The apparatus 200 may include a base band 202, an upper curl-forming element 204 and a lower curl-forming element 205. The base band 202 may be an individual loop having an inner surface 206, an outer surface 208, a top edge 210 and a bottom edge 212. The two curl-forming elements 204-205 may be individual loops having a circular, oval, flat or amorphous cross-section. The two curl-forming elements 204-205 may be in contact with the base band 202, such that the two curl-forming elements 204-205 may be on the outer surface 208 of the base band 202, thereby creating closed-loops 214-215 between the base band 202 and the two curl-forming elements 204-205. The elements (including one or more of the base band 202, the upper curl-forming element 204 and the lower curl-forming element 205) may be connected by a connecting element 216. The connecting element 216 may connect the base band 202 and the two curl-forming elements 204-205 in one or several locations along the surface of the base band 202, permanently or reversibly. The connecting element 216 may include one or more of snaps, VELCRO, hooks, loops, holes, stitches, clips or any other attachment means.

Accordingly, an exemplary method for curling hair includes the user's hair being sectioned into two parts, thereby creating an upper crown section and a lower section and applying the base band 202 to the circumference of the head such that the hair is in contact with the inner surface 206 of the base band 202 and the curl-forming elements 204-205 are on the outer surface of the base band 202. Hair exits the base band 202 from one of the bottom edge 212 and the top edge 210. A section of hair from the crown section of the user's head is wrapped over and under the outer surface of the upper curling-forming element 204, through the closed-loop 214. The next section of hair encompasses the end portion of the preceding section as well as a new section of hair. The new and preceding sections are bundled together and taken over and through the closed-loop 214 in the same manner as described above. This is repeated until all the hair in the upper portion is wrapped. Similarly, a section of hair from the lower section, is wrapped under and over the surface of the lower curling-forming element 205, through the closed-loop 215. The next section of hair encompasses the end portion of the preceding section as well as a new section of hair. The new and preceding sections are bundled together and taken under and over and through the closed-loop 215 in the same manner as described above. This is repeated until all the hair in the upper portion is wrapped.

Figure 3A:
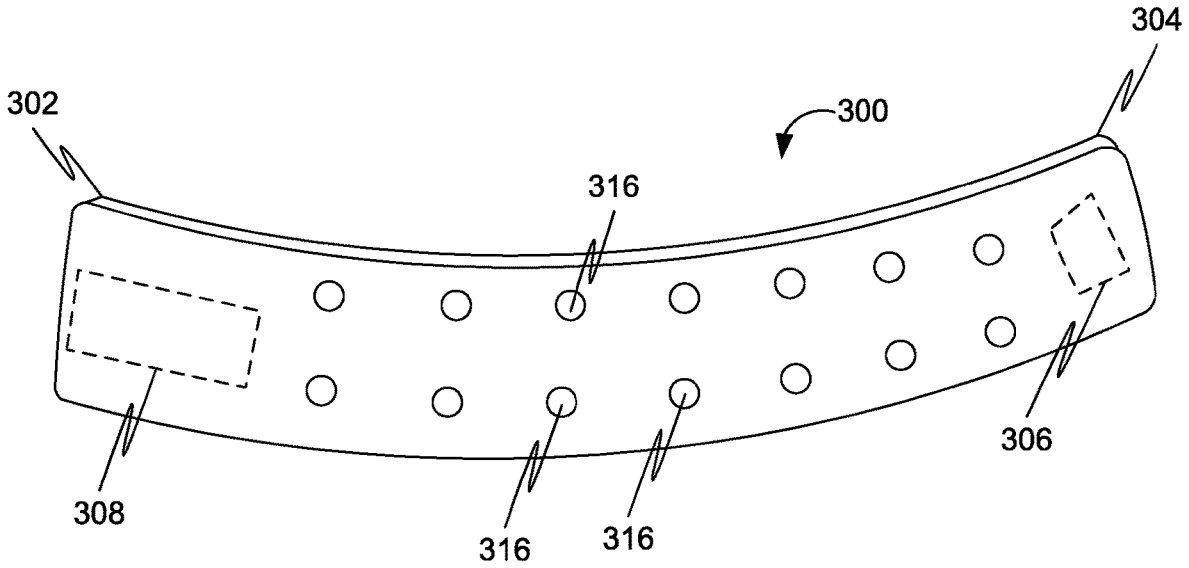
FIG. 3A shows a front view of a base band of an apparatus for hair curling, in accordance with some embodiments.

FIG. 3A show a front view of a base band 300 of an apparatus for hair curling, in accordance with some embodiments. In this embodiment, the base band 300 may include a first end 302 and a second end 304, with a first fastener 306 attached to the first end 302 of the base band 300 and at least one second fastener 308 attached to the second end 304 of the base band 300, wherein the first fastener 306 is configured to engage with the at least one second fastener 308, thereby creating an individual loop. Further, there may be more than one first and second fasteners, or the first and second fasteners are of a certain length to enable a size of the individual loop of the base band to be adjustable.

Figure 3B:
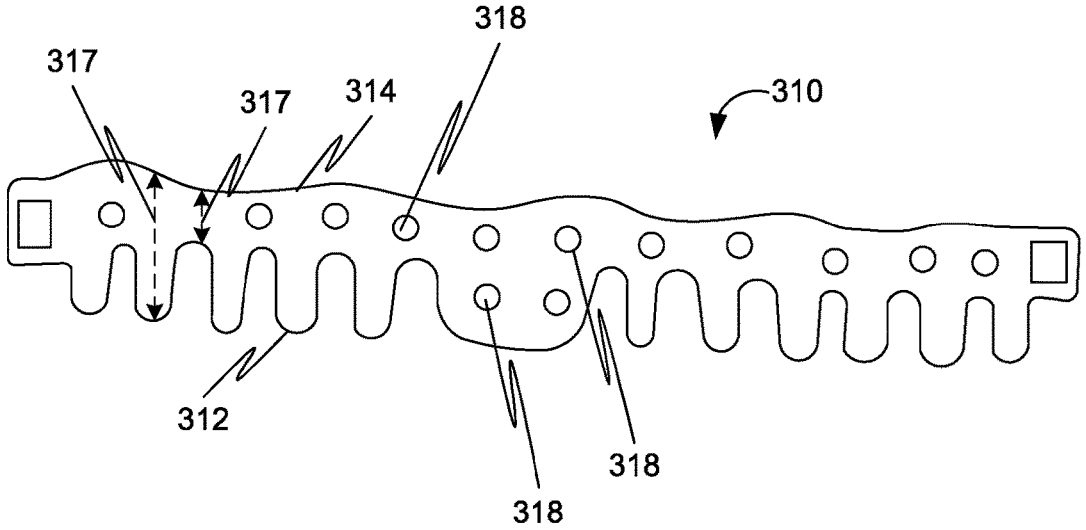
FIG. 3B shows a front view of a base band of an apparatus for hair curling, in accordance with further embodiments.

FIG. 3B shows a front view of a base band 310 of an apparatus for hair curling, in accordance with further embodiments that are shown in FIG. 3A. As shown, the height 317 of the base band 310 varies along a length of the base band 310, a bottom edge 312 may have an uneven configuration, further, a top edge 314 may have an uneven configuration. For example, as shown in FIG. 3B, the height 317 of the base band 310 alternates in a periodic fashion. In other embodiments, the height 317 may vary in a non-periodic fashion. The uneven configuration of the top and or bottom edges creates a more natural interface with the user's hair, further a periodic configuration allows the user to estimate the size of a section, and to better grip the hair once it is wrapped around the baseband.

Figure 3C:
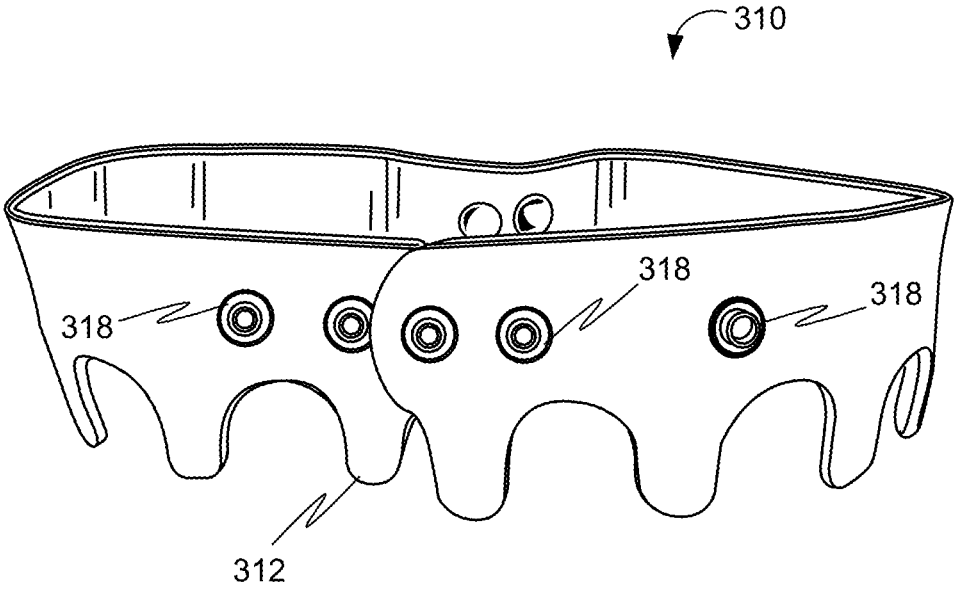
FIG. 3C shows a perspective view of the base band in FIG. 3B in a circular configuration.

FIG. 3C shows a perspective view of a base band similar to the base band 310 in a circular configuration in order to be wrapped around the user's head. Also, as shown in FIGS. 3A, 3B and 3C, one or more connecting elements 316-318 may be disposed on the outer surface of the base bands 300-310 respectively, so as to mate to one or more connecting elements on a curl-forming element.

Figure 4A:
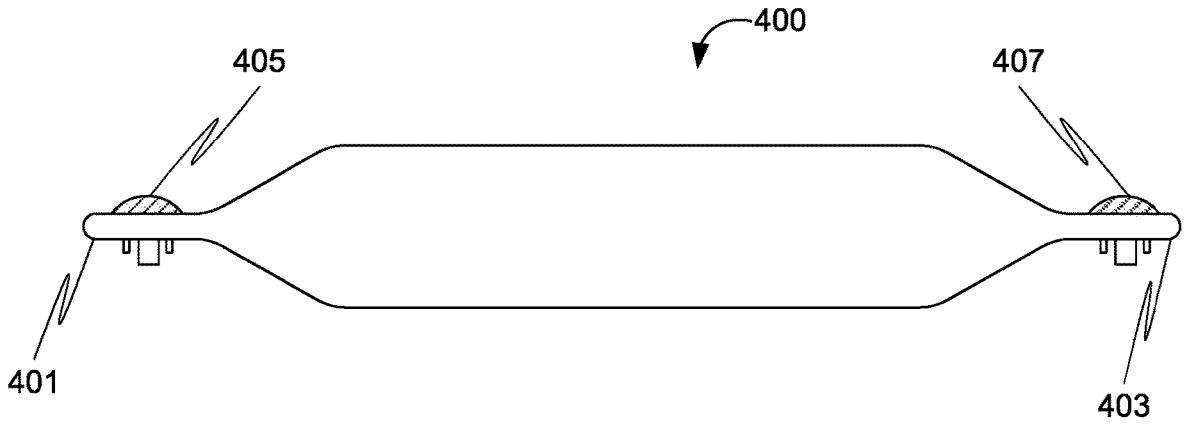
FIG. 4A shows a side view of a curl forming element of an apparatus for hair curling, in accordance with some embodiments.
Figure 4B:
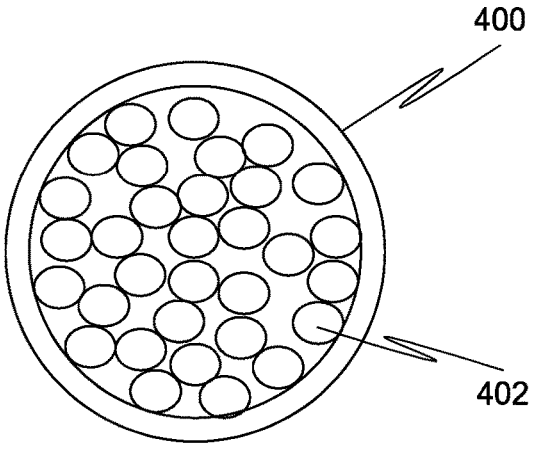
FIG. 4B shows a cross-section view of the curl forming element of FIG. 4A.

FIG. 4A shows a side view of a curl-forming element 400 of an apparatus for hair curling, wherein the curl-forming element 400 comprises an elongated body having a first end 401 and a second end 403, a first connecting element 405 and a second connecting element 407, wherein the first and second connecting elements 405-407, are disposed at the first end 401 and the second end 403, of the curl-forming element 400 respectively, wherein each of the first connecting element 405 and the second connecting element 407 are configured for mating with corresponding connecting elements disposed on the outer surface of the base band, wherein the mating may permanent or reversible. Further, in accordance with some embodiments. The curl forming element 400 may have heat retaining properties. For example, the curl forming element 400 can be heated within a microwave and remains heated long enough to apply heat onto the user's hair. FIG. 4B shows a cross-section view of the curl forming element 400. The curl forming element 400 may include a heat-retaining filling 402, which includes, but is not limited to, a quantity of gel, a quantity of silicone, a quantity of seeds, or a quantity of beads or any other know heat retaining fillings.

Figure 5A:
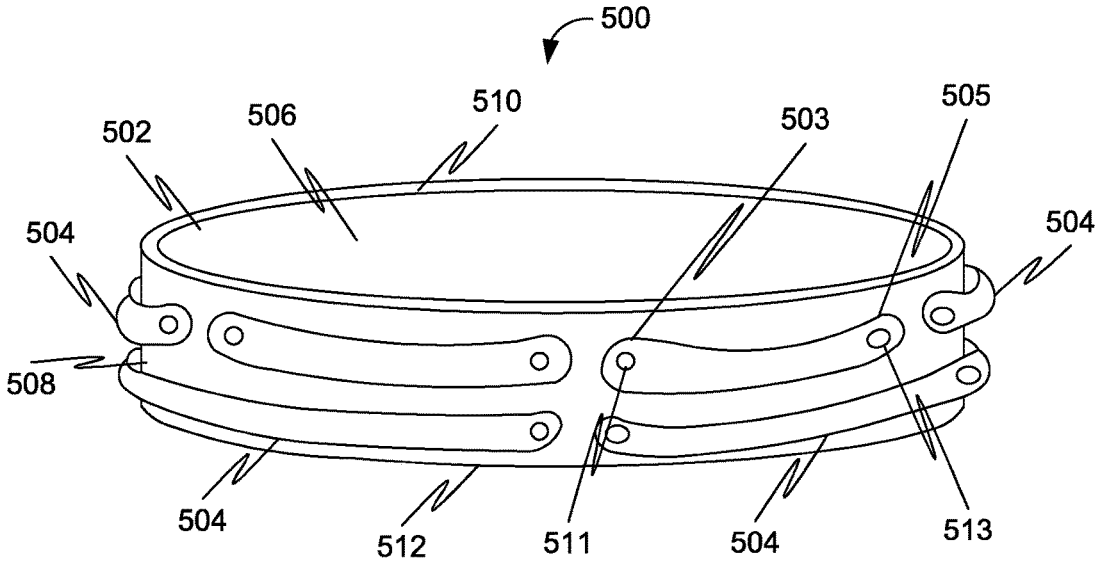
FIG. 5A shows a perspective view of an apparatus for hair curling, in accordance with some embodiments.
Figure 5B:
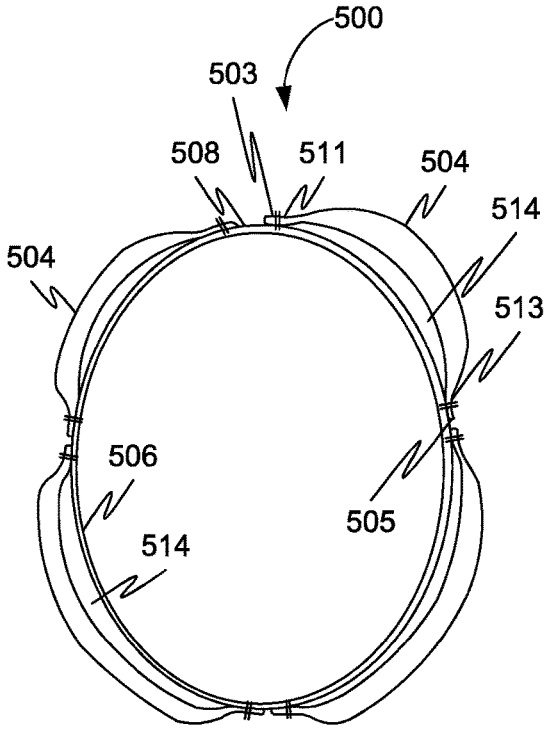
FIG. 5B shows a top view of the apparatus of FIG. 5A.
Figure 5C:
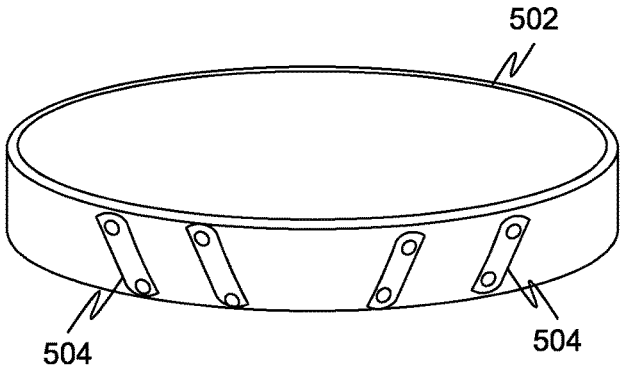
FIG. 5C shows a perspective view of the apparatus for hair curling, according to further embodiments.

FIGS. 5A-5C show an apparatus 500 for hair curling, in accordance with some embodiments. Specifically, FIG. 5A shows a perspective view of the apparatus 500, and FIG. 5B shows a top view of the apparatus 500. The apparatus 500 may include a base band 502 and multiple curl-forming elements 504. The base band 502 may be an individual loop having an inner surface 506, an outer surface 508, a top edge 510 and a bottom edge 512. A curl-forming element 504 may have a first end 503 and a second end 505, wherein the first end 503 is connected to the outer surface 508 of the base band 502 via connecting elements 511 and the second end 505 is connected to the outer surface 508 of the base band 502, via connecting elements 513 thereby creating a closed-loop 514 between the base band 502 and the curl-forming element 504. Multiple curl-forming elements 504 may be attached to the base band 502 simultaneously, thereby creating multiple closed-loops 514. Such that, the curl-forming elements 504 form outer layers with respect to the outer surface of the base band 508, and the base band 502 forms an inner layer with respect to the curl-forming elements 504, wherein the closed loops 514, are provided between the outer and inner layers, and where the closed loop is bounded by two connecting elements 511-513. The curl-forming elements 504 may be fabricated to be attached to the base band 502 in a number of formations, including but not limited to, an upper and lower tier formation, a diagonal formation (as shown in FIG. 5C). FIG. 5C shows a perspective view of the apparatus 500, according to further embodiments. Several connecting elements may connect the base band 502 and the curl-forming elements 504 permanently or reversibly. Further, the connecting elements may include one or more of snaps, VELCRO, stitches, clips, hooks or any other attachment means. For example, reversible methods of attachment such as hook and loops or snaps may be used. The user may wrap sections of hair around the curl-forming elements 504 through the closed loops 514. Thereafter, the user may unfasten the connecting elements 511-513, to release the curl-forming elements 504 from the base band 502, thereby easily unrolling and releasing the hair from the curl-forming elements 504. As the curl-forming elements 504 are removable from the base band 502, a user is afforded the option to select from a variety of diameters and cross-sections for the curl-forming elements 504. Further, the curl-forming elements 504 or closed-loop assemblies may be attached to the base band 502 to create any configuration as per the user's requirements. The closed-loop assembly may be used individually or as part of a group, with the length of the closed-loop assembly increased or decreased as necessary.

Figure 6A:
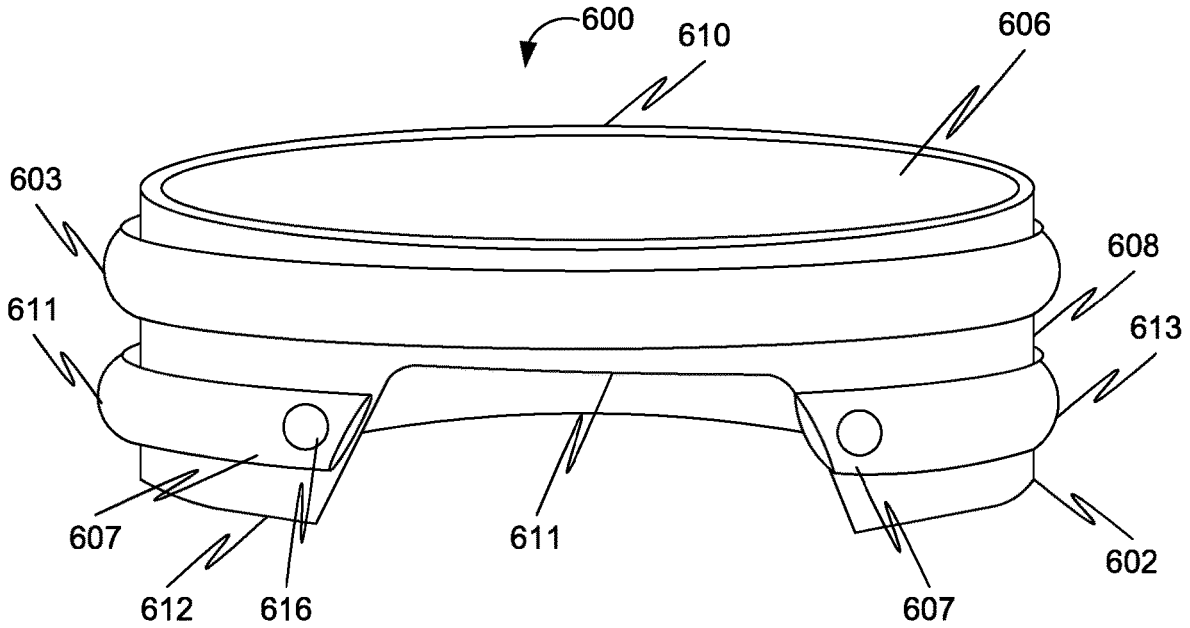
FIG. 6A shows a perspective view of the apparatus for hair curling, in accordance with some embodiments.
Figure 6B:
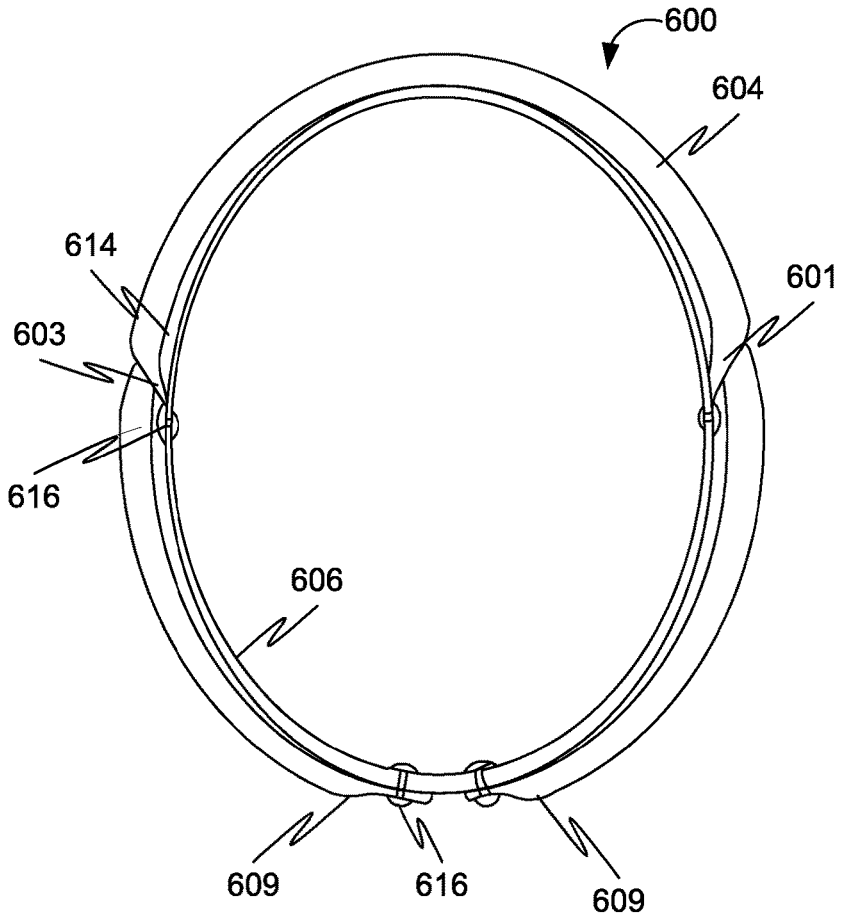
FIG. 6B shows a top view of the apparatus of FIG. 6A.

FIGS. 6A and 6B show an apparatus 600 for hair curling, according to some embodiments. Specifically, FIG. 6A shows a perspective view of the apparatus 600 and FIG. 6B shows a top view of the apparatus 600. The apparatus 600 may include a base band 602. The base band 602 may be an individual loop having an inner surface 606, an outer surface 608, a top edge 610 and a bottom edge 612. The front portion of the bottom edge 612 features a cutout 611, thereby locally reducing the height of the base band 602 at an interface with the user's face. The cutout 611 may have any suitable shape, such as but not limited to, trapezoid, rectangular, oval or an amorphous formation providing the user with greater comfort and visibility. Further, the cutout 611 may enable the user to easily wrap hair at the front of the head that may be of shorter length. An upper curl-forming element 604 may be an individual loop or may have a first end 601 and a second end 603, wherein the first end 601 may be connected towards the top edge 610 of the base band 602 and the second end 603 may be connected towards the top edge 610 of the base band 602 on the outer surface 608 of the base band 602, by connecting elements 616, thereby creating a closed-loop 614 between the base band 608 and the upper curl-forming element 604. Two lower curl-forming elements 611-613 each having a first end 607 and a second end 609 connected to the base band 602 via connecting elements 616, permanently or reversibly. Several curl-forming elements may be attached to the base band 602 in the same manner, towards the top edge 610 and bottom edge 612 of the base band.

In various exemplary embodiments, the curl-forming elements may be one continuous loop as shown in FIGS. 1A-C, or they maybe elongated, having a first end and a second end as shown in FIG. 4. The curl-forming elements may be connected to the base band in one, two or more places, or may be formed out of a portion of the base band itself, such as the embodiments explain in conjunction with FIGS. 14A-14D below. The curl-forming elements may be fabricated from one or more of cloth fabric, elastic material, rubber composite, molded plastic, metal sheeting, metal wire, molded foam, foam tubing or any other suitable known material. The curl forming elements may be fabricated in a variety of cross-sections including, but not limited to, circular, oval, flat or an amorphous cross-section. The curl forming elements may be rigid or flexible in nature. The curl-forming elements may comprise of a composition of materials like a strip of elastic stitched to a strip of non-elastic material or molding. Alternatively, the curl-forming element may be fabricated from foam tubing. Alternatively, curl-forming elements may be fabricated in an elongate pocket-like configuration that may be filled with filling agents such as gel, foam, seeds, beads. Alternatively, the pocket-like configuration may house a prefabricated sachet that may be filled with a filling agent such as gel and grains. These filling agents having their own characteristics such as the ability to be heated and hold heat, absorb moisture, expel moisture or a moisturizing agent, expel fragrance or create buoyancy, thereby impacting the condition and end result of the hair style. Materials which are heat absorbent (e.g. silicone gel beads) may be heated to improve the hair curling process. Heating may be accomplished through a variety of means; for example, by using a microwave (when safe to do so).

Alternatively, a curl-forming element maybe fabricated as a loop, wherein the loop may attach to a baseband element, forming an upper and lower tier curl-forming element. This is an alternative to providing two independent members to create the upper and lower tier curl-forming elements. Connecting elements may be attached to the ends of the loop. The connecting elements may include one or more of snaps, hooks, eyelets or any other attachment means.

Figure 7A:
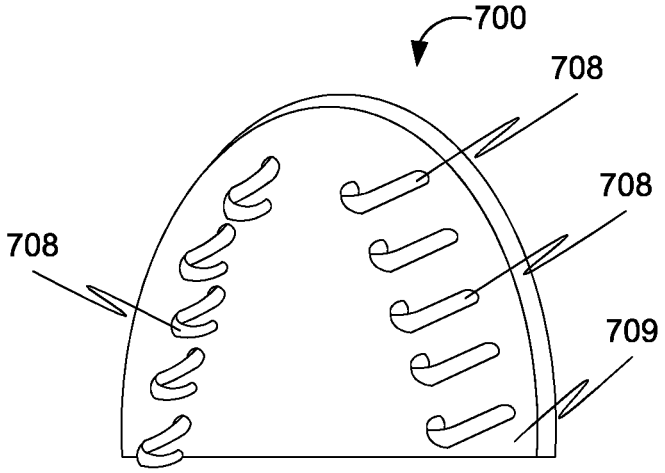
FIG. 7A shows a side view of a connecting element of an apparatus for hair curling, according to some embodiments.
Figure 7B:
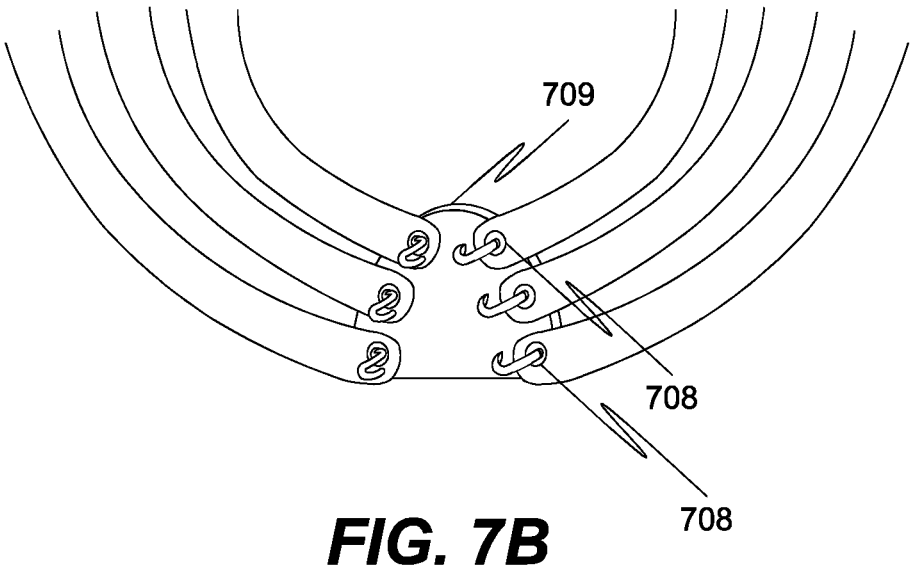
FIG. 7B shows closed loop assemblies attached using the multiple hooks of the connecting element of FIG. 7A.

FIG. 7A shows a side view of an extension member 700 of an apparatus for hair curling, according to some embodiments. The extension member 700 may be located at any location of a base band. In one embodiment, the extension member 700 is positioned on the base band in a manner that puts it on a user's forehead when the base band is secured around the user's head. The extension member 700 may include, a base 709, one or more connecting elements 708, arranged in a clustered formation thereby attaching multiple curl forming elements to the base band in a local area. Instead of hooks 708, the connecting elements could alternatively be snaps, clips or VELCRO. FIG. 7B shows multiple curling-forming elements attached to a single extension member 700, using the multiple hooks 708 of the extension member 700 of FIG. 7A.

Figure 7C:
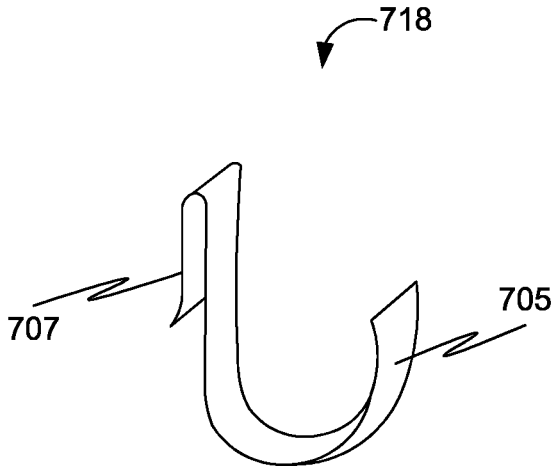
FIG. 7C shows a perspective view of a clip as a connecting element that may be used to couple a base band and curl-forming elements of the apparatus for hair curling, according to some embodiments.

FIG. 7C shows a perspective view of an extension element in the form of a clip 718 that may be used to couple the base band and curl-forming element of the apparatus for hair curling. A slide portion 707 of the clip 718 may attach to the base band of the apparatus for hair curling. The cup portion 705 of the clip 718 may hold the curl-forming element of the apparatus for hair curling.

Figure 8A:
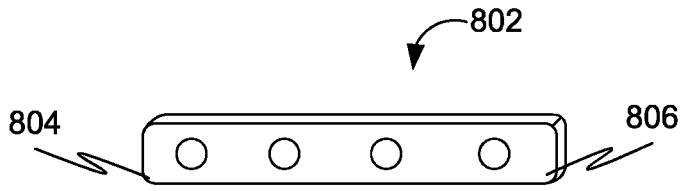
FIG. 8A shows a front view of an extension member with an elongated configuration, according to some embodiments.
Figure 8B:
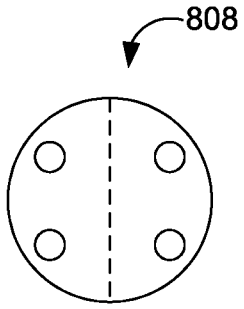
FIG. 8B shows a front view of an extension member with a circular configuration, according to some embodiments.
Figure 8C:
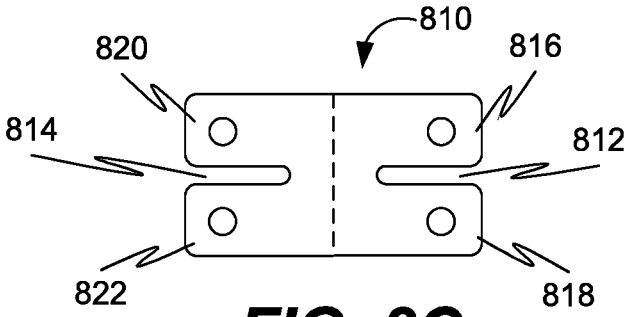
FIG. 8C shows a front view of an extension member comprising slits, according to some embodiments.
Figure 8D:
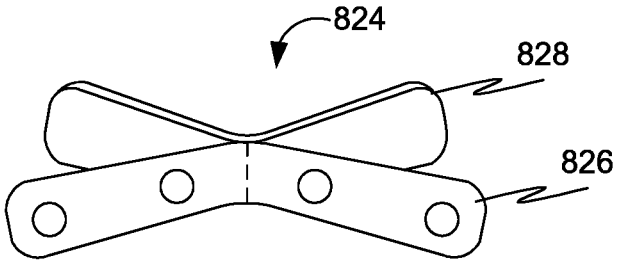
FIG. 8D shows a front view of an extension member comprising a top layer and a bottom layer, according to some embodiments.
Figure 9A:
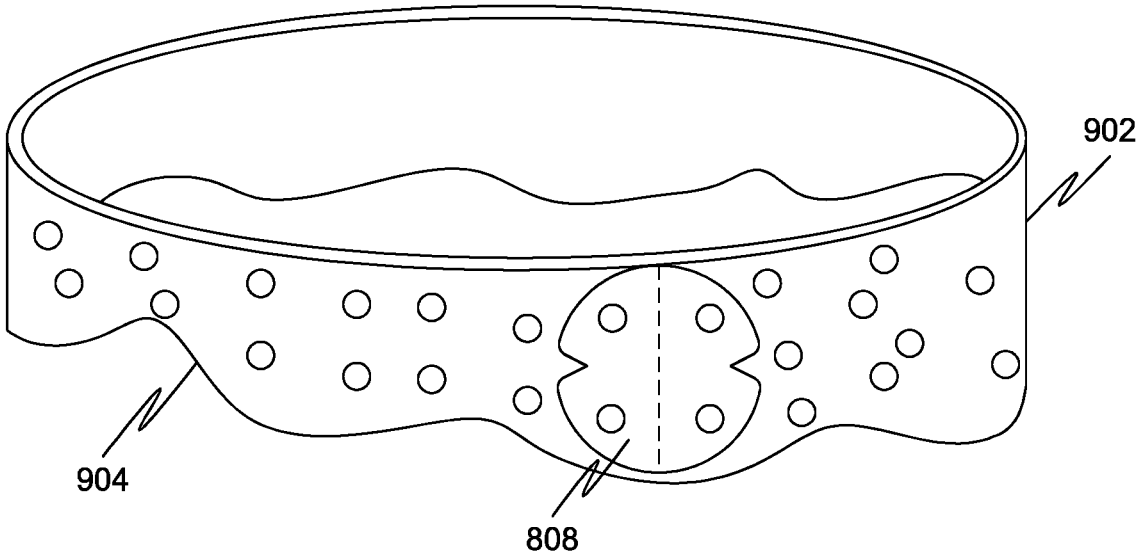
FIG. 9A shows a perspective of an extension member attached to a base band, according to some embodiments.
Figure 9B:
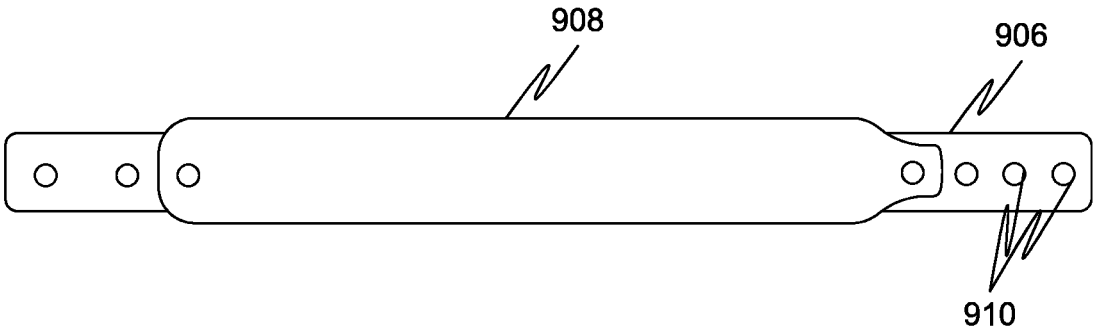
FIG. 9B shows an extension member which may act as a length increaser for a curl forming element, according to some embodiments.

FIGS. 8A-8D show front views of different versions of an extension member. An extension member may be configured to be an intermediate element between the base band and the one or more curl-forming elements. FIG. 8A shows a front view of an extension member 802 which may have an elongated configuration. The extension member 802 may include a first end 804 and a second end 806, wherein the extension member 802 may further include multiple connecting elements disposed along the length of the extension member, as well as on the first end 804 and the second end 806. FIG. 8B shows a front view of an extension member 808 which may have a circular configuration. The extension member 808 may include one or more additional connecting elements arranged in a clustered formation thereby connecting multiple curl forming elements to the base band in a local area. Further, the extension member 808 may be configured to attach to the base band at one of a central point an axis, with multiple connecting elements disposed around one of the central point and the axis. FIG. 8C shows a front view of an extension member 810 comprising slits 812-814 thereby creating multiple segmented portions 816-822 within the extension member 810, wherein each segmented portion may include one or more connecting elements. FIG. 8D shows a front view of an extension member 824 comprising a top layer 826 and a bottom layer 828, wherein the top layer 826 may be attached to the bottom layer 828, wherein the bottom layer 828 may be configured to be attached to the base band, wherein the top layer maybe configured to attach to the curl-forming elements. Where each of the top layer 826 and the bottom layer 828 may include one or more connecting elements configured to connect the extension member 824 to the one or more curl-forming elements, FIG. 9A shows the extension member 808, which acts as a hub to connect multiple curl forming elements. The extension member 808 may be attached to a base band 902 at one of a central point an axis. For example, the extension member 808 may be stitched to the base band 902. The base band 902 may have an uneven configuration 904 such as a wavy bottom edge or a serrated bottom edge. FIG. 9B shows an extension member 906, which may attach to curl-forming element 908, thereby increasing the length a curl forming element 908. Further, additional connecting elements 910, along the body of the extension element allow the user to adjust the length of the curl-forming element 908.

Figure 10A:
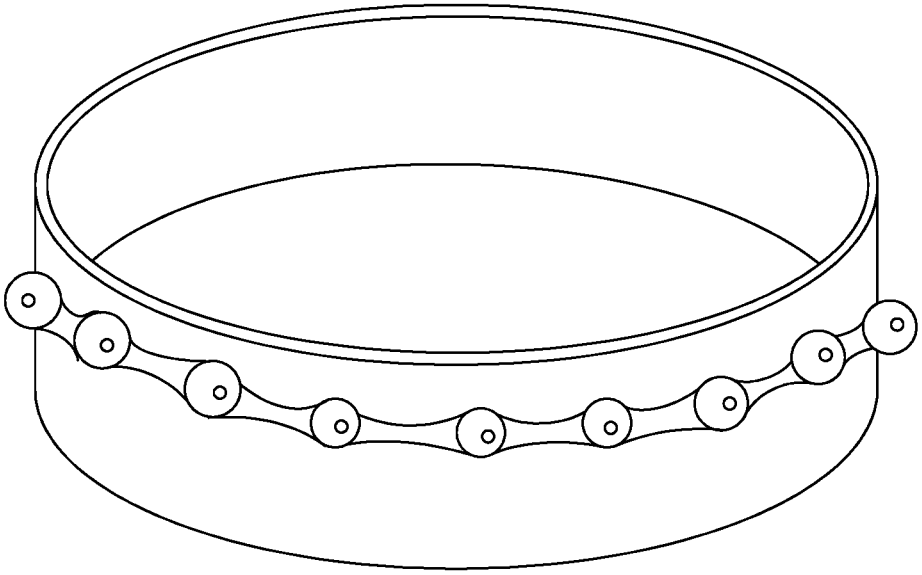
FIG. 10A shows a perspective view of an apparatus for hair curling with curl-forming elements having an alternating cross-section, in accordance with some embodiments.
Figure 10B:
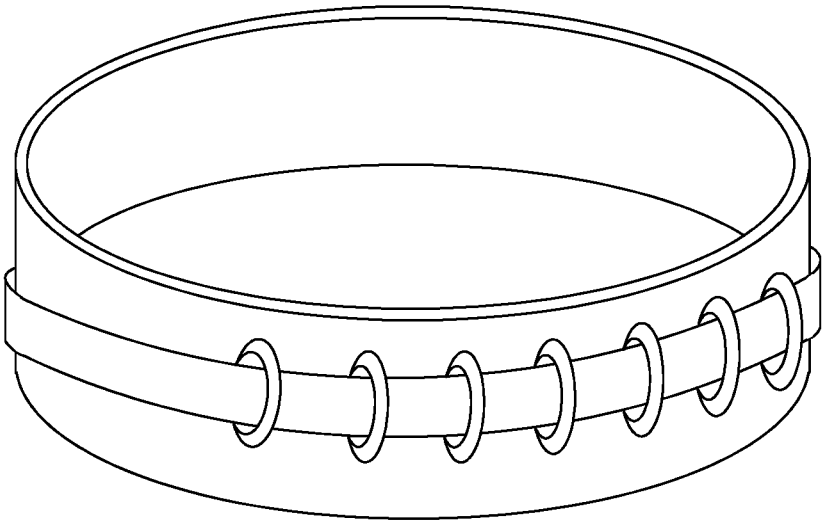
FIG. 10B shows a perspective view of an apparatus for hair curling with curl-forming elements having free sliding dividing elements, in accordance with some embodiments.

Further, in other exemplary embodiments, the curl-forming elements may have an alternating cross-section, as shown in FIG. 10A, thereby impacting the manner in which the wrapped hair clusters around the curl-forming element. The varying cross-section may separate each warped cycle of hair. Alternatively, the curl-forming element may have free sliding dividing elements to separate the hair, as shown in FIG. 10B. Such configurations are advantageous as they result in improved gripping of a user's hair, preventing sliding and generally increasing user-friendliness the apparatus for hair curling.

In some embodiment, an apparatus for hair curling may include a base band, which may be made from a strip of material, having a first end and second end, the first and second ends may be connected adjustably at the front via fasteners. The fasteners may include one or more of a series of snaps, a strip of VELCRO, stitches, clips, hooks or any other attachment means, thereby allowing the user to tighten or loosen the base band to suit their needs. Curl-forming elements may be attached to the outer surface of the base band via connecting elements. The base band may form a barrier, protecting the user's head and hair from tugging, snagging, and heat damage. It also secures the hair in place for engagement with the curl-forming elements. Further, it may form the anchor point for connecting one or more curl-forming elements. In various exemplary embodiments, the base band may be one continuous loop or may be a strip, having a first end and a second end that is formed into a loop by connecting the first end and the second end. Therefore, the base band may be opened and closed around the user's head. Alternatively, the base band may be formed from several strips of material to form a loop. Alternatively, the base band may be adjustable in nature, having a first end and a second end brought together by an adjustable fastener, such as, but not limited to, a hook and loop system, clips, hook and loop fabric such as VELCRO or a series of snaps. Therefore, the base band may be loosened or tightened according to the needs and physiology of the user. The base band may be skinny and may be narrower than the curl-forming elements. The base band may be fabricated from one or more of cloth fabric, elastic material, rubber composite, molded plastic, molded silicon, metal sheeting, metal wire, molded foam, or any other suitable known material. Further the base band maybe fabricated from loop fabric such as VELTEX, thereby creating a plethora of connecting hooks all along the outer surface of the baseband. The base band may be fabricated in a variety of cross-sections including, but not limited to, circular section, semi-circular hollow section, flat and an amorphous cross-section. They may be rigid or flexible. They may have an elasticated or non-elasticated nature. The base band may comprise of a composition of materials, for example, a length of elastic stitched to a length of non-elastic material. The base band may be made of water absorbent material, such as terrycloth. The base band may be made of porous material, such as foam. The base band may be made of material with the ability to be heated and hold heat, such as a gel filling.

Figure 11A:
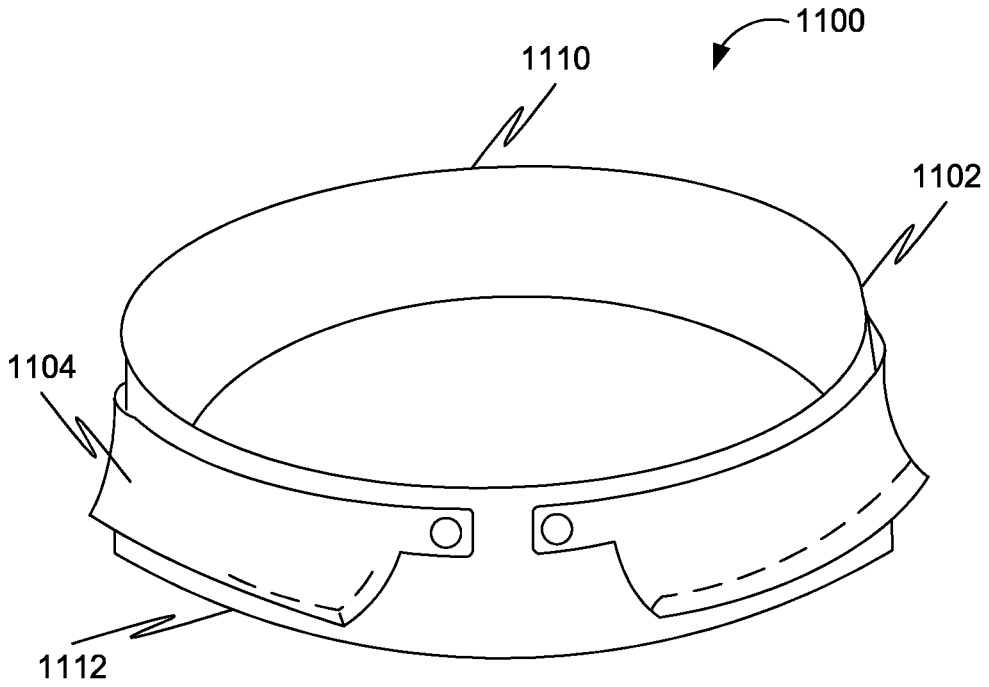
FIG. 11A shows a perspective view of the apparatus for hair curling, in accordance with some embodiments.
Figure 11B:
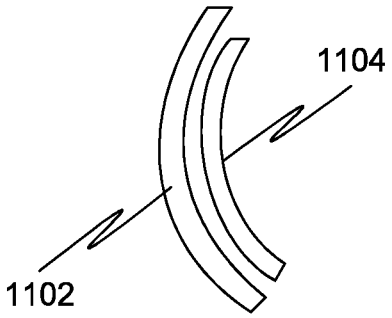
FIG. 11B shows a cross-section view of the apparatus of FIG. 11A.
Figure 11C:
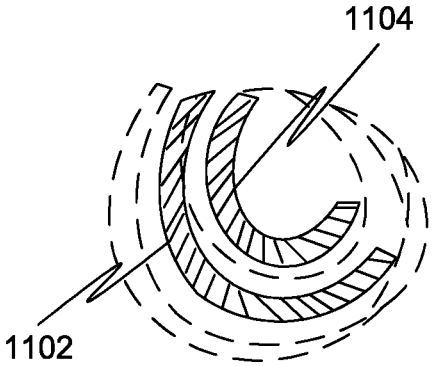
FIG. 11C shows a cross-section view of the apparatus of FIG. 11A with hair running through the apparatus for hair curling.

FIGS. 11A-11C show an apparatus 1100 for hair curling, according to some embodiments. FIG. 11A shows a perspective view of the apparatus 1100. The apparatus 1100 may include a base band 1102, wherein the base band element 1102 may have an inner surface, an outer surface, a top edge 1110 and a bottom edge 1112. The apparatus 1100 may also include a curl-forming element 1104, wherein the curl-forming element 1104 may have a flat cross-section, which can be easily flexed and rolled. FIG. 11B shows the cross section of the assembly. As hair is wrapped around the curl-forming element 1104 through the closed loop, the bottom edge 1112 of the base band 1102 and the curl-forming element 1104 take on a more circular cross-section, shown in FIG. 11C.

Figure 12A:
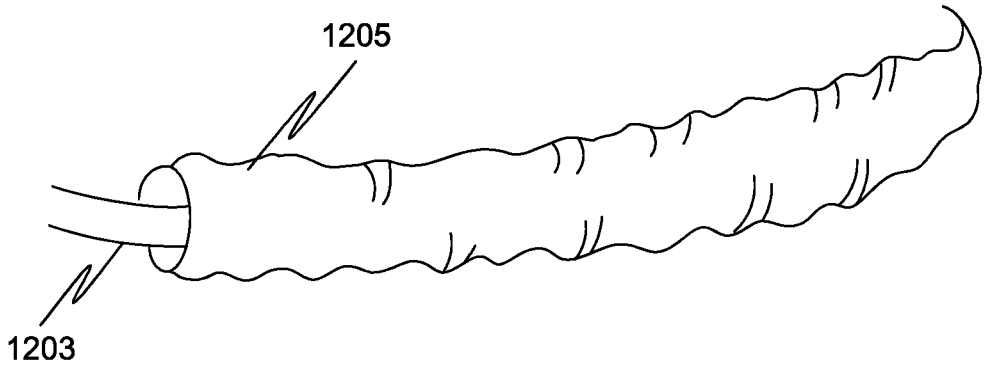
FIG. 12A shows a perspective view of a curl-forming element of an apparatus for hair curling, in accordance with some embodiments.
Figure 12B:
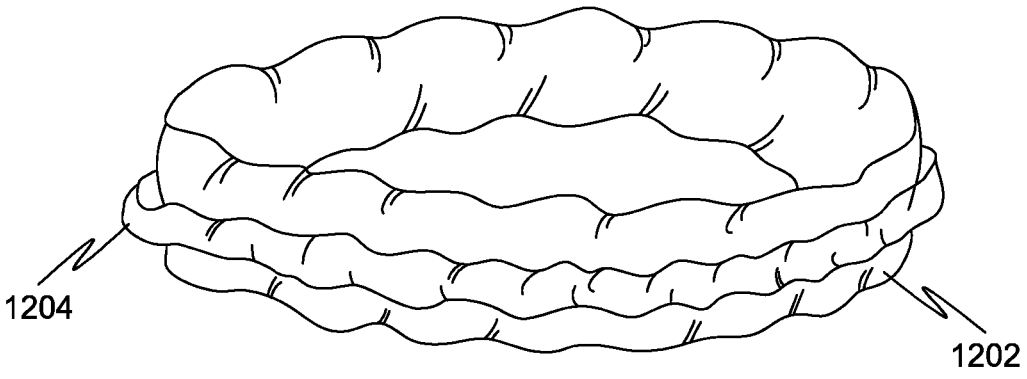
FIG. 12B shows a base band and a curl-forming element assembly of FIG. 12A.

FIG. 12A shows an exemplary embodiment where a curl-forming element may be an assembly comprising of a core elongate element 1203 and an outer sleeve element 1205, wherein the core elongate element 1203 and the sleeve element 1205 may be connected in at least one location along the length. The sleeve element 1205 may slide relative to the core elongate element 1203, so the hair may be wrapped around the sleeve element 1205 and may be moved relative to the core elongate element 1203. The sleeve element 1205 may be made from a slippery fabric such as satin, silk or polyester. FIG. 12B shows a base band element 1202 and a curl-forming element 1204 assembly, wherein the base band 1202 is similarly encapsulated within a sleeve element.

Figure 13A:
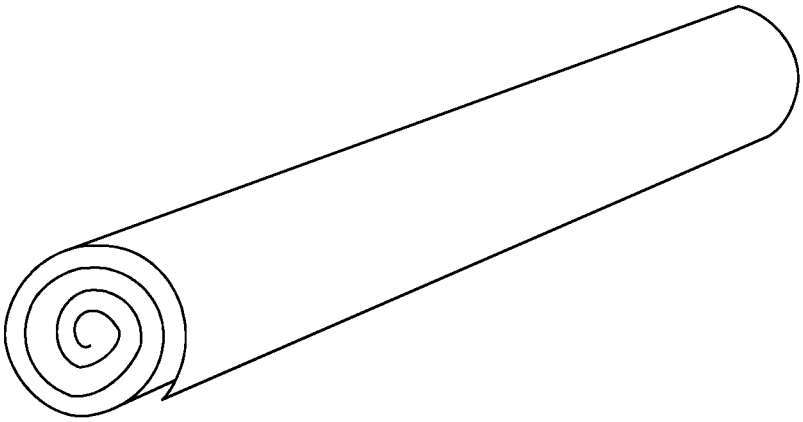
FIG. 13A shows a perspective view of a curl-forming element formed using a rolled-up fabric, in accordance with some embodiments.
Figure 13B:
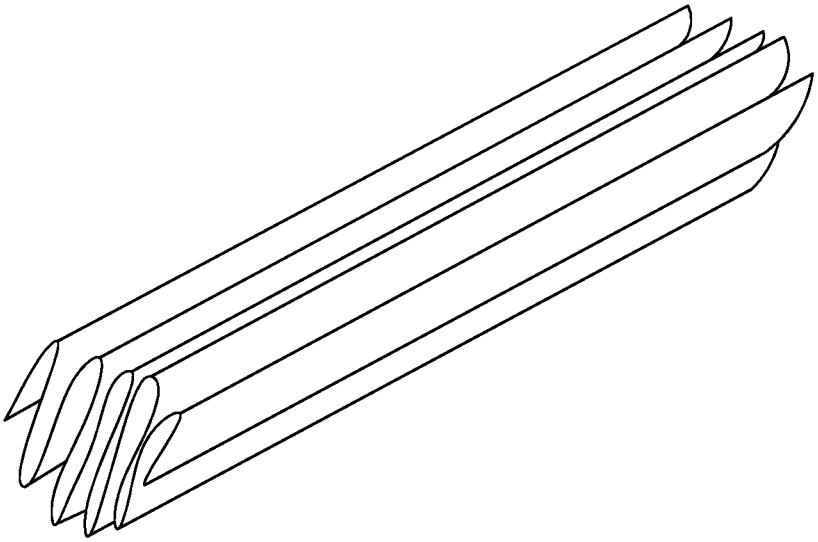
FIG. 13B shows a perspective view of a curl-forming element formed using a folded-up fabric, in accordance with some embodiments.

Alternatively, the curl-forming element may be a rolled-up fabric, thereby forming a compressible circular cross-section as shown in FIG. 13A. Alternatively the curl-forming element may be folded-up along the length of fabric thereby forming an amorphous cross-section as shown in FIG. 13B.

Figure 13C:
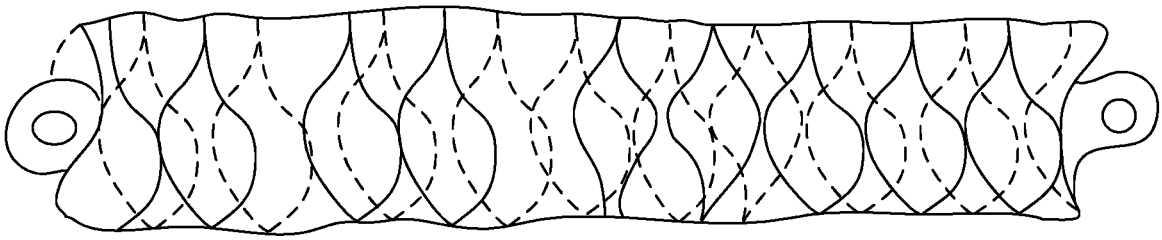
FIG. 13C shows a side view of hollow tube-like structures for forming a curl-forming element, in accordance with some embodiments.
Figure 13D:
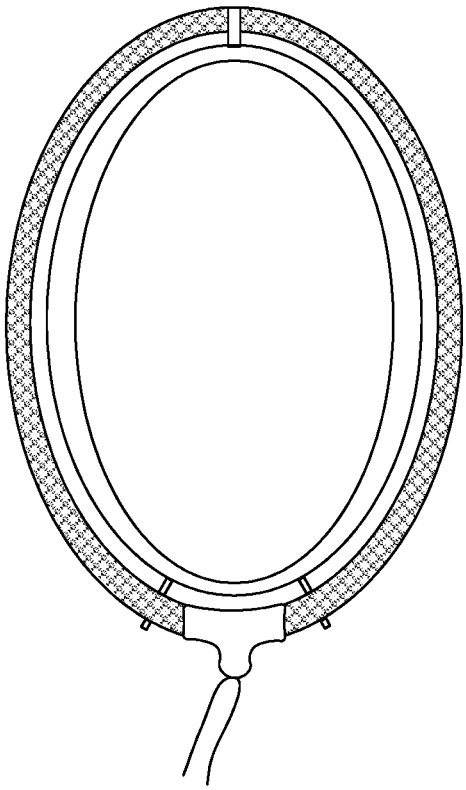
FIG. 13D shows a top view of curl-forming element and base band assembly of FIG. 13C.

In alternate embodiments, the curl-forming elements may be formed as hollow tube-like structures, such as a spring, net or a double helix configuration shown in FIG. 13C. Such configurations allow air (forced or ambient) through the curl-forming element, thereby accelerating the hair drying process. FIG. 13D shows a top view of the curl-forming element and the base band assembly of FIG. 13C, wherein the curl-forming element may be attached to the base band by means of a series of hooks, such as the extension member described in FIG. 7C. In various exemplary embodiments, a tubular bracket connects the first end and the second end of the curl-forming elements together and facilitates air flow to the curl-forming element.

Figure 14A:
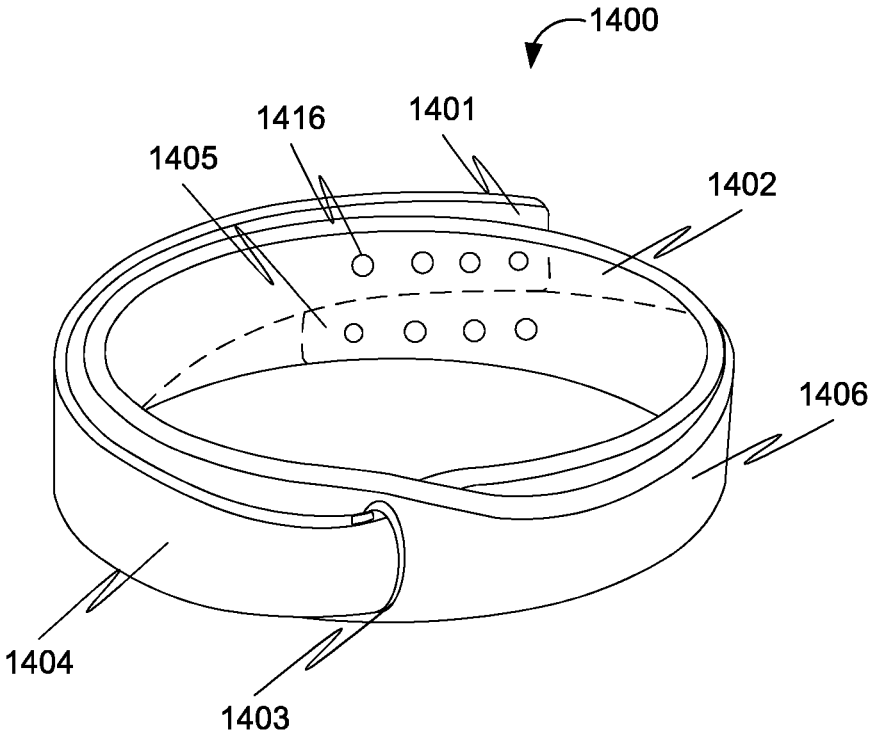
FIG. 14A shows a perspective view of the apparatus for hair curling, in accordance with further embodiments.

FIG. 14A shows a perspective view of an apparatus 1400 for hair curling, according to some embodiments. The apparatus 1400 may include a single length of fabric forming a base band 1402 and curl-forming elements 1404-1406. The length of fabric, having a first end 1401 and a second end 1405, may feed into an integrating slit 1403. The first end

1401 of the material may go through the slit 1403, thereby forming the base band 1402. Upon exit from the slit 1403, the length of fabric may form a secondary layer, which acts as the curl-forming element 1404. The length of fabric from the second end 1405 of the material till the slit 1403, forms a secondary layer, which acts as the curl-forming element 1406. The ends 1401-1405 of the curl-forming elements may be attached to the base band 1402 via connecting elements 1416.

Figure 14B:
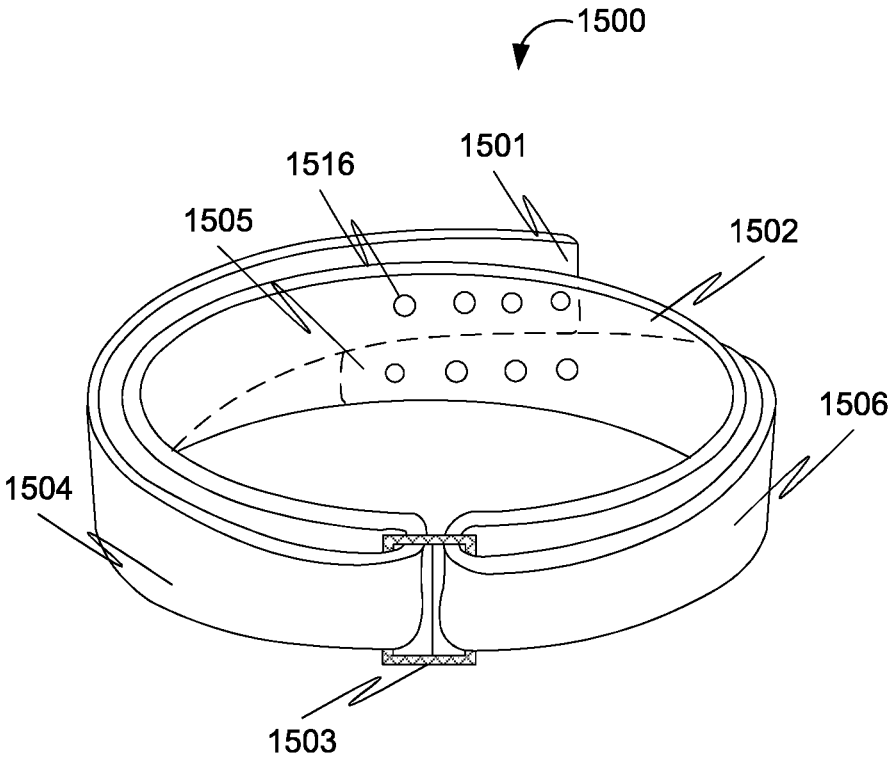
FIG. 14B shows a perspective view of the apparatus for hair curling, in accordance with further embodiments.

FIG. 14B shows a perspective view of an apparatus 1500 for hair curling, according to some embodiments. The apparatus 1500 may include a single length of fabric forming a base band 1502 and curl-forming elements 1504-1506. The length of fabric, having a first end 1501 and a second end 1505, may feed into an integrating clip 1503. The first end 1501 of the base band 1502 may go through and around the clip 1503, changing direction and folding on itself, thereby forming a secondary layer, which acts as the curl-forming element 1504. The second end 1405 of the base band 1502 may go through and around the clip 1503, changing direction and folding on itself, thereby forming a secondary layer, which acts as the curl-forming element 1506. The ends 1501-1505 of the curl-forming elements may be attached to the base band 1502 via connecting elements 1516.

Figure 14C:
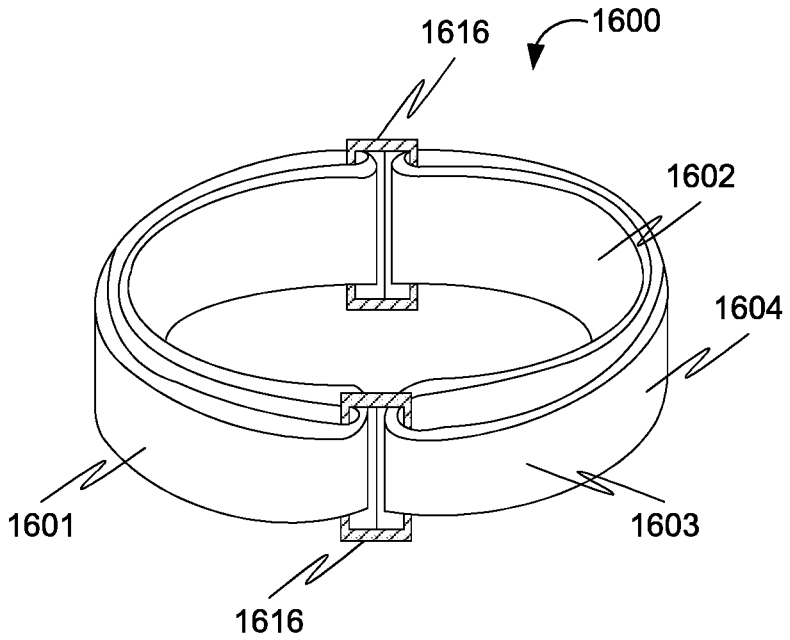
FIG. 14C shows a perspective view of the apparatus for hair curling, in accordance with further embodiments.
Figure 14D:
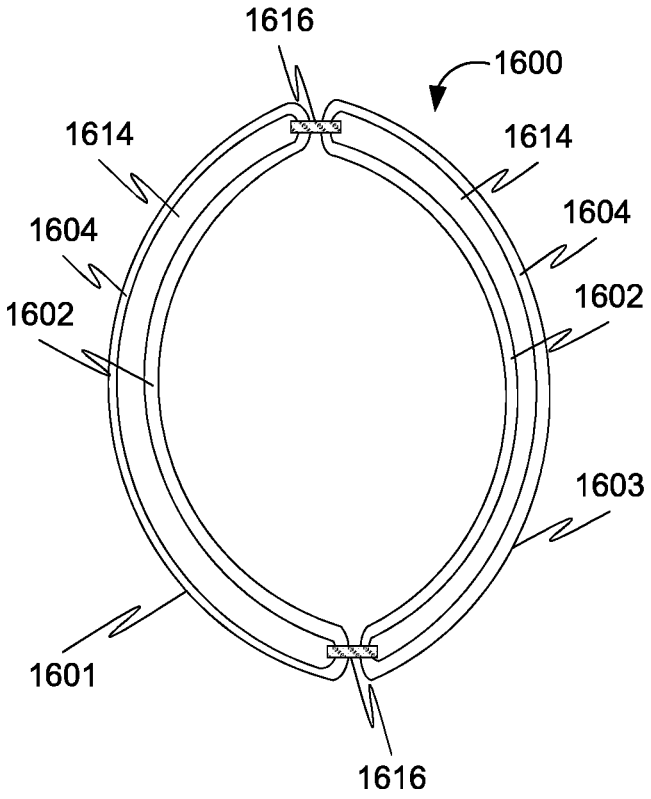
FIG. 14D shows a perspective view of the apparatus for hair curling, in accordance with further embodiments.

FIG. 14C shows a perspective view of an apparatus 1600 for hair curling, according to some embodiments. FIG. 14D shows a top view of the apparatus 1600 for hair curling. The apparatus 1600 may include two loops 1601-1603, having an inner layer 1602 and an outer layer 1604. The two loops 1601-1603 are connected by two connecting elements 1616, thereby creating two closed loops 1614. The inner layers 1602 form the base band and the outer layers 1604 form the curl-forming elements. The connecting elements 1616 may include one or more of stitches, hooks, loops, slider clips or any other attachment means. Alternatively, in further embodiments, the apparatus 1600 may comprise of multiple loops, having an inner layer and an outer layer, connected by connecting elements resulting in multiple closed loops.

In various exemplary embodiments the connecting elements may be formed with one or more of snap-on clips, hook and loop fasteners, buttons, eyelets, buckles, and any other attachment means. Different types of connecting elements may provide different advantages and disadvantages, while remaining within the scope of the present disclosure.

Although the invention has been explained in conjunction with a number of embodiments, it is evident that many alternatives, modifications and variations would be or are apparent to those of ordinary skill in the applicable arts. Accordingly, applicant intends to embrace all such alternatives, modifications, equivalents and variations that are within the spirit and scope of this invention.

I claim:

1. An apparatus for hair curling, the apparatus comprising:

a base band comprising an inner surface and an outer surface;

a plurality of curl-forming elements that are formed from a first material having a substantially hollow tube structure, with a hollow center; wherein the hollow center is filled with a second material that is different than the first material;

a plurality of connecting elements configured to connect the plurality of curl forming elements to the base band thereby creating closed loops between the base band and the plurality of curl-forming elements, the plurality of curl-forming elements each comprising an elongated body having a first end and a second end, wherein a first connecting element and a second connecting element are disposed at the first end and the second end respectively, wherein each of the first connecting element and the second connecting element are configured to connect the outer surface of the base band; wherein the plurality of curl-forming element follows a contour of the outer surface of the base band; and wherein the plurality of curl-forming element is configured to form an outer layer with respect to the outer surface of the base band, wherein the base band forms an inner layer with respect to the plurality of curl-forming element, wherein a closed loop is provided between the outer and inner layers, wherein the closed loop is bounded by the connecting elements.

2. The apparatus of claim 1, wherein the base band is an individual loop.

3. The apparatus of claim 1, wherein the base band comprises a first fastener attached to a first end of the base band and at least one second fastener attached to a second end of the base band, wherein the first fastener is configured to engage with the at least one second fastener thereby creating an individual loop.

4. The apparatus of claim 3, wherein at least one of the first fastener and the at least one second fastener is configured to enable a size of the individual loop to be adjustable.

5. The apparatus of claim 1, wherein a plurality of connecting elements are disposed on the outer surface of the base band configured for mating with the first connecting element and the second connecting element disposed at the first end and second end of the curl-forming elements.

6. The apparatus of claim 1, wherein the plurality of curl-forming element is an individual loop characterized by one of a circular cross-section, a flat cross-section, alternating cross-section or an amorphous cross-section.

7. The apparatus of claim 1, wherein the plurality of curl-forming element comprises a plurality of curl-forming elements disposed on the outer surface of the base band.

8. The apparatus of claim 1, wherein the plurality of curl-forming element comprises a first curl-forming element disposed on an upper region of the outer surface of the base band and a second curl-forming element disposed on a lower region of the outer surface of the base band.

9. The apparatus of claim 1, wherein the bottom edge of the base band comprises a cut-out configured to expose a user's forehead when the apparatus is worn by the user.

10. The apparatus of claim 1, wherein the at least one curl-forming element is fabricated from at least one of cloth fabric, elastic material, rubber composite, molded plastic, metal sheeting, molded foam and foam tubing.

11. The apparatus of claim 1, wherein the at least one curl-forming element is characterized by an alternately varying cross-section.

12. The apparatus of claim 1, wherein a height of the base band varies across a length of the base band.

13. The apparatus of claim 12, wherein the height of the base band alternates in a periodic fashion.

14. The apparatus of claim 1, wherein the base band comprises an integrated heat protectant layer.

15. The apparatus of claim 1, wherein the second material with has heat retaining properties.

16. The apparatus of claim 1 further comprises an extension member configured to be an intermediate element between the base band and the plurality of curl-forming element.

17. The apparatus of claim 16, wherein the extension member is elongated, wherein the extension member comprises a first end and a second end, wherein the extension member further comprises at least two connecting elements disposed on the first end and the second end.

18. The apparatus of claim 16, wherein the extension member comprises at least one additional connecting element arranged in a clustered formation thereby connecting the plurality of curl forming elements to the base band in a local area.

19. The apparatus of claim 16, wherein the extension member is configured to attach to the base band at one of a central point an axis, with at least two connecting elements disposed around one of the central point and the axis.

20. The apparatus of claim 16, wherein the extension member comprises of slits thereby creating a plurality of segmented portions within the extension member, wherein each segmented portion comprises at least one connecting element.

21. The apparatus of claim 16, wherein the extension member comprises a top layer and a bottom layer, wherein the top layer is attached to the bottom layer, wherein the bottom layer is configured to be attached to the base band, wherein each of the top layer and the bottom layer comprises at least one connecting element configured to connect the extension member to the plurality of curl-forming element.

* * * * *